US006561951B2

(12) United States Patent
Cannon et al.

(10) Patent No.: US 6,561,951 B2
(45) Date of Patent: May 13, 2003

(54) NETWORKED BIOMETRICALLY SECURED FITNESS DEVICE SCHEDULER

(75) Inventors: Joseph M. Cannon, Harleysville, PA (US); James A. Johanson, Macungie, PA (US)

(73) Assignee: Agere Systems, Inc., Berkeley Heights, NJ (US)

( * ) Notice: Subject to any disclaimer, the term of this patent is extended or adjusted under 35 U.S.C. 154(b) by 32 days.

(21) Appl. No.: 09/741,343

(22) Filed: Dec. 21, 2000

(65) Prior Publication Data

US 2002/0082142 A1 Jun. 27, 2002

(51) Int. Cl.[7] ..... A63B 21/00
(52) U.S. Cl. ..... 482/1; 482/4; 482/8
(58) Field of Search ..... 482/1–9, 900–902

(56) References Cited

U.S. PATENT DOCUMENTS 5,394,879 A 3/1995 Gorman
5,719,950 A 2/1998 Osten et al.
6,052,723 A 4/2000 Ginn
6,053,844 A 4/2000 Clem
6,059,692 A 5/2000 Hickman

FOREIGN PATENT DOCUMENTS

EP 0 919 259 A1 2/1999

*Primary Examiner*—Glenn E. Richman
(74) *Attorney, Agent, or Firm*—Dickstein Shapiro Morin & Oshinsky LLP

(57) ABSTRACT

An apparatus and method are provided for scheduling and controlling access to physical fitness devices. A prospective user makes an entry into a reservation system reserving the timeframe to use a particular fitness device. Each physical fitness device is provided with a biometric sensor that allows a prospective user to enter biometric data into a database. The database contains records of each prospective user's biometric data. The reservation system and the biometric characteristics database are associated with a central controller. A prospective user is identified by providing biometric data to the database via the sensor associated with a particular fitness device. The central controller determines whether or not to allow the user access by determining if the user is scheduled in the reservation system.

38 Claims, 3 Drawing Sheets

NETWORKED BIOMETRICALLY SECURED FITNESS DEVICE SCHEDULER

FIELD OF THE INVENTION

The present invention relates to the field of physical fitness equipment. More specifically, it relates to controlling access to physical fitness equipment utilizing biometric data.

BACKGROUND OF THE INVENTION

Modern gymnasiums and exercise facilities contain a great number of various physical fitness exercise equipment. This equipment includes stationary bicycles, treadmills, stair steppers, weight resistance machines, and many others. The attraction for individual users to purchase memberships to such gymnasiums and exercise facilities is the opportunity to use many different types of exercise equipment. It is not practical or affordable to have the variety of exercise equipment in the individual's home.

With the number of persons becoming members of gymnasiums increasing, scheduling the use of individual exercise equipment becomes problematic. It is an inevitable problem that certain exercise equipment becomes more popular than others among users, or that certain exercise equipment is in greater demand due to its limited supply. Continuous unavailability of certain exercise equipment because other individuals are using it often causes gymnasium members to become discontent and to cancel their memberships.

Existing scheduling techniques used by gymnasium staffs consist of taking reservations over the phone, or instituting a sign-up log sheet. These techniques, however, fall short of solving the scheduling problem. For example, difficulties continue to arise when unauthorized users begin using exercise machines out of turn. Additionally, these techniques do not address concerns of gymnasiums that have franchises in multiple locations. Existing reservation techniques do not allow a member of such a gymnasium to make a reservation to use exercise equipment at various locations. What is needed is a system that combines scheduling and access control for individual exercise equipment located at one or more gymnasium locations.

BRIEF SUMMARY OF THE INVENTION

The present invention provides a method and apparatus for scheduling use and controlling access to exercise equipment using biometric data. An electronic reservation system is provided to enable potential users to schedule desired date and time of use for physical fitness devices at one or more gymnasium locations. Individual physical fitness devices are provided with a sensor capable of perceiving biometric characteristics from a potential user. Prior to initiating use of a particular fitness device, the potential user provides personal biometric data to the sensor. The biometric data is sent to a biometric characteristics database that identifies the potential user. The potential user's identity is then compared with the information in the reservation system to determine whether or not to allow the potential user access to the particular fitness device.

Such access control allows a scheduler or owner of the exercise equipment to effectively manage a reservation system for individual pieces of exercise equipment in one or more locations. It also allows the scheduler or owner to enable use, or exclude unauthorized use, of the exercise equipment. The biometric data may include various body characteristics, such as fingerprints, eye retinas, and facial patterns.

BRIEF DESCRIPTION OF THE DRAWINGS

These and other features and advantages of the invention will be more clearly understood from the following detailed description of the invention which is provided in connection with the accompanying drawings in which.

DETAILED DESCRIPTION OF THE INVENTION

Figure 1:
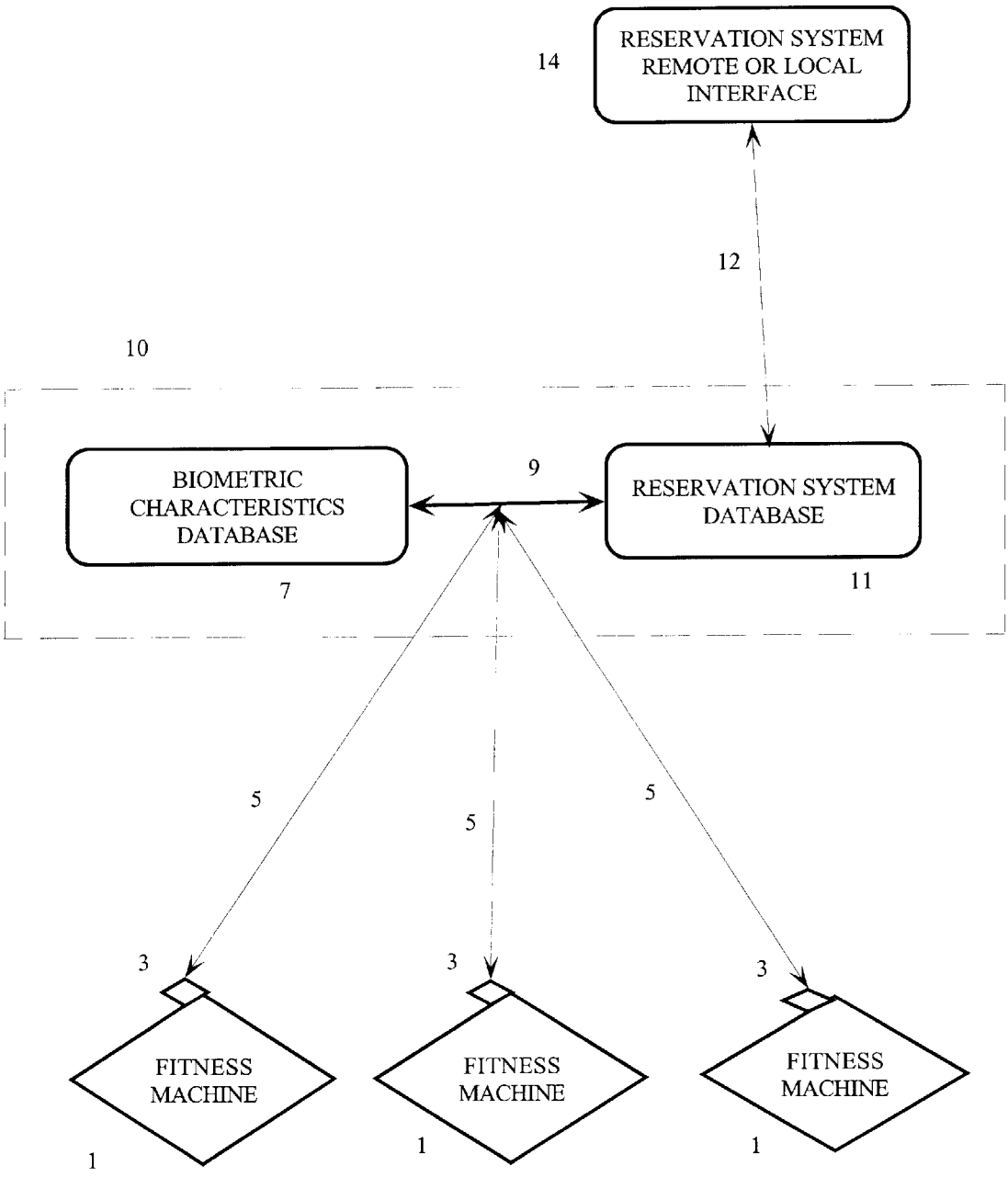
FIG. 1 shows a general layout of the system.

As illustrated in FIG. 1, the invention is used with one or more fitness machines 1 located in a physical fitness facility. Biometric readers or sensors 3 are located on or near each fitness machine. Each biometric sensor 3 is capable of enabling and disabling each associated fitness machine. Each biometric sensor 3 is connected to a biometric characteristics database 7 via a signal line 5. The signal line 5 can be a wired connection, wireless local area network connection, or other wireless connection such as Bluetooth. The biometric characteristics database is connected to a reservation system database 11 via a signal line 9. Similarly, signal line 9 can be a wired connection, wireless local area network connection, or other wireless connection such as Bluetooth. Reservation system database 11 can be associated with biometric characteristics database 7 in a central controller 10, such as a computer. Alternatively, reservation system database 11 can be separate from the biometric characteristics database 7. Fitness equipment reservations are entered into the reservation system database 11 through a remote or local interface 14 via a communications link 12. Communication link 12 may be as simple as a keyboard connection for a computer containing the databases 7 and 11, or may be a wired or wireless telephone link, or Internet link, or other communications link such as Bluetooth.

Figure 2:
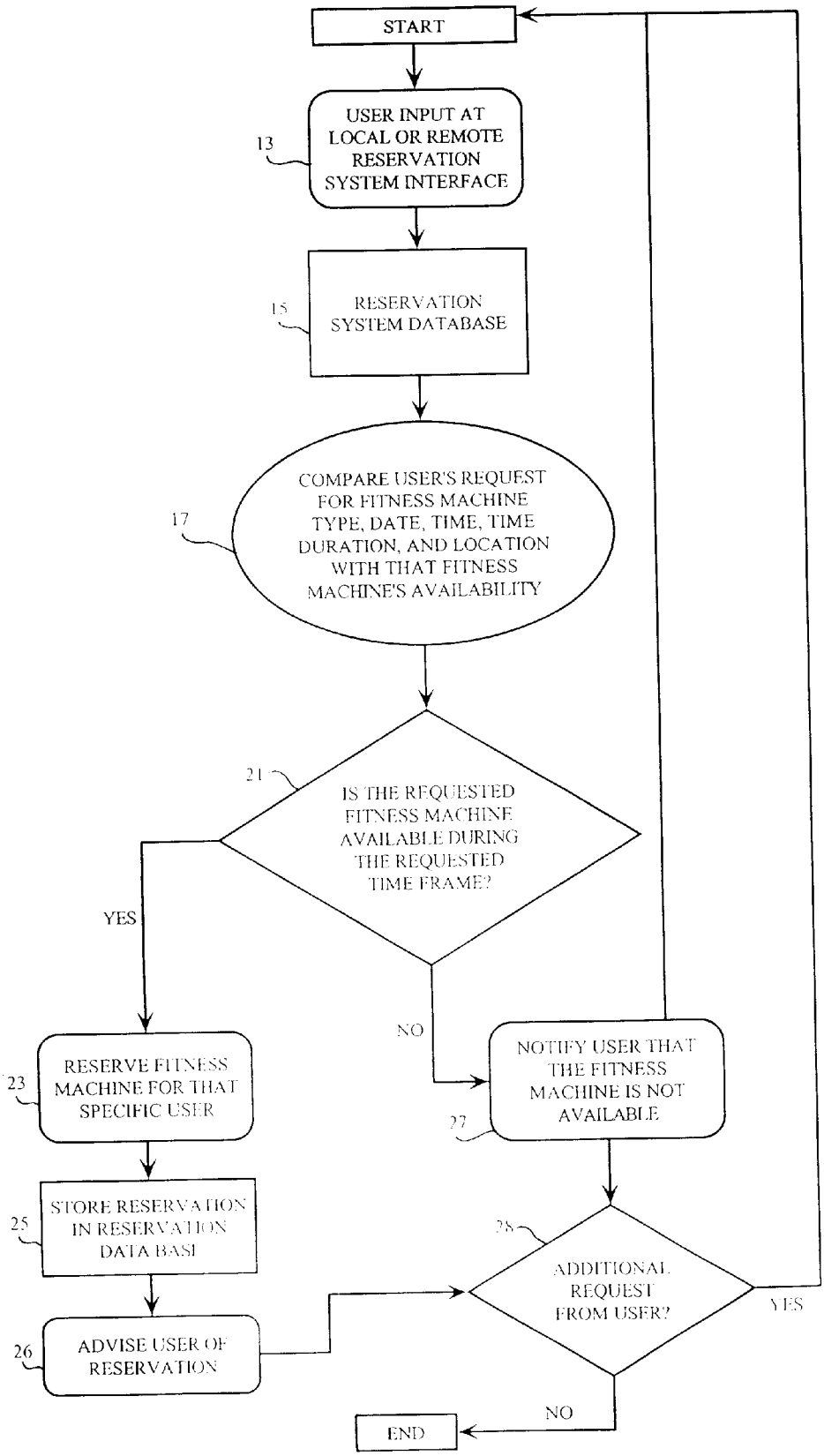
FIG. 2 shows a diagram of the reservation process.

As shown in FIG. 2, the method of the present invention begins when a user initiates a reservation process for a particular piece of exercise equipment (Block 13). The user can be at a local keyboard, or at a remote system interface, or utilize various other interface 14 methods that would allow the user to send and receive information, such as registration via the telephone or internet. The user inputs information on a) the desired exercise equipment, b) preferred day and time of use, c) preferred time duration of use, and d) similar information for using additional exercise equipment as desired. If the user is a member of an exercise facility that has more then one location, e.g. franchises in different cities, the user would also enter the desired location of the exercise equipment. This step allows gymnasiums to better serve members who travel between locations where a particular gymnasium may have franchise or member exercise facilities.

The information input by the user is then transferred to the reservation system database 11 (Block 15). The reservation system database contains information on all exercise equipment available for use in the particular gymnasium or exercise facility, and its affiliated locations. The reservation system compares the user's request with the availability of the exercise equipment (Block 17), and determines whether the requested exercise equipment is available during the day and time requested (Block 21). The reservation system database 11 can be contained in one central location. Alternatively, the reservation system database 11 can be comprised of multiple databases in various locations. Such multiple databases can be located on each piece of exercise equipment, or in a central location in each gymnasium. If multiple reservation databases 11 are utilized, the databases would communicate with each other over communication links such as wired or wireless telephone links, or Internet links, or other communications links such as Bluetooth.

If the reservation system database 11 determines that the exercise equipment is available during the time period requested, it reserves the equipment for the specific user (Block 23), and stores the information in the reservation system database 11 (Block 25). The reservation system database 11 then sends a signal, via the same communication link 12 used by user to input information or another link, advising the user that a reservation has been made (Block 26). If the reservation system database 11 determines that the exercise equipment is for any reason not available as requested by user, it notifies the user that the request cannot be completed (Block 27). The user is then able to request additional reservations as desired (Block 28). The user learns whether the request has been accepted or denied via the same interface 14 used to contact the reservation system database 11 or a different interface. For example, a user may access the reservation system database 11 via a personal computer by direct connection or electronic mail and receive a reply via the same computer, or via a different interface such as a pager, electronic mail, wired or wireless telephone, etc. The reservation system may be remotely accessed by a user not only by computer directly or by electronic mail, but also by pager, wire or wireless telephone, personal digital access device, or various other communications device. The user may also choose to receive periodic reminders of the reserved schedule from the reservation system database 11 via an interface the user chooses. For example, the user may choose to receive a reminder via electronic email one hour before scheduled reservation time period begins. The process illustrated in FIG. 2 is executed, for example, by a central controller 10, e.g. a computer system that manages databases 7 and 11.

Figure 3:
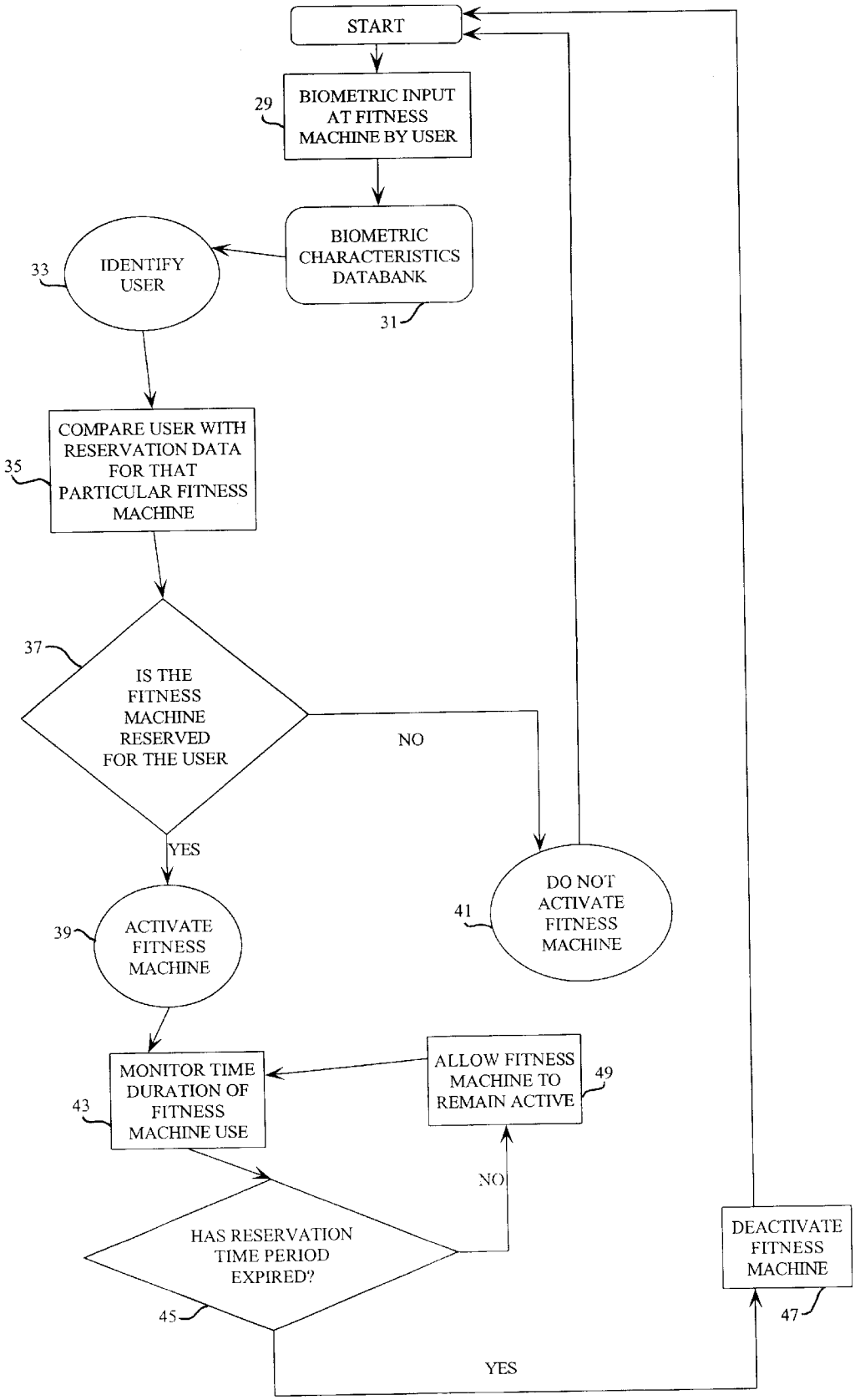
FIG. 3 shows a diagram of the user identification process.

As shown in FIG. 3, the next phase of the present invention takes place at the fitness machine in the gymnasium or fitness facility. Each fitness machine 1 has an associated biometric sensor 3. The user, prior to initiating use of a machine, must input a biometric characteristic into the biometric sensor 3 (Block 29). The biometric characteristic can be any one or a combination of human characteristic chosen by the particular exercise facility, such as a fingerprint, facial pattern, eye retina, or others. The biometric characteristic is transmitted from the biometric sensor 3 to the biometric characteristics database 7 where the characteristic is compared with stored data and the specific user is identified (Block 33). After the identification is completed, the information regarding the specific user, the fitness machine, the location (if applicable), and the time the request is made is compared with the information stored in the reservation system database 11 (Block 35). The reservation system database 11 makes the determination whether to grant or deny user access to the fitness machine (Block 37).

If the comparison confirms that the user does not have a reservation for that particular piece of fitness equipment, the reservation system database 11 does not cause central controller 10 to activate the fitness machine (Block 41). Consequently, a person who does not have a reservation to use a particular reserved fitness machine is precluded from initiating exercise. If the particular fitness machine is not reserved in the reservation system database 11, the user may initiate exercise on the machine for a desired time duration by providing a biometric characteristic input to sensor 3, so long as the time duration does not conflict with an existing reservation. Alternatively, the user may simply initiate use of an unreserved machine without providing a biometric input. In this case, the central controller 10 would enable the unreserved machine to remain active for a predetermined time duration so as not to conflict with an existing or potential reservation.

If the comparison confirms that the user has a reservation for that particular piece of fitness equipment, the reservation system database 11 causes the central controller 10 to activate the fitness machine (Block 39). Enabling activation is accomplished by sending a signal from the central controller 10 to the biometric sensor 3 via signal line 5 indicating that the associated fitness machine 1 can be activated. Upon receiving the enabling signal, sensor 3 activates the associated fitness machine 1. The method for sensor 3 to activate an associated fitness machine 1 will vary according to control logic of various fitness machines.

After the fitness machine 1 is enabled, the reservation system database 11 makes certain that the user does not occupy the fitness machine for a duration longer then the reserved time period. This can be accomplished, for example, by a simple "time-out" function. The central controller 10 can send a signal to the biometric sensor 3 to initiate an internal "time-out" function equivalent to the reserved time period. For example, if the user reserved the fitness machine 1 for twenty minutes, the signal from central controller 10 to sensor 3 to enable the fitness machine 1 would also initiate a "time-out" function within the biometric sensor equipment to count twenty minutes and then disable the fitness machine 1. Alternatively, the "time-out" function can be performed within the central controller 10, and upon counting the time period of the fitness machine's 1 reservation, the central controller 10 would send a signal to biometric sensor equipment to disable the associated fitness machine 1. This sequence is illustrated in Blocks 43, 45, 47, and 49. If the reserved timeframe has not expired, the fitness machine is allowed to remain active (Block 49). If the reserved timeframe has expired, the fitness machine is deactivated (Block 47).

This step ensures that the user does not exceed the timeframe for which the fitness machine was reserved, and that subsequent users with a reservation can access the fitness equipment. In the event that a prospective user wishes to use a fitness machine that has not been reserved in the reservation system database 11, the central controller 10 may enable use of that fitness machine until such a time when that fitness machine has been reserved.

Thus, a method and apparatus are provided to facilitate scheduling of fitness equipment utilizing user's biometric characteristics. The method and apparatus described above allows a physical fitness facility to effectively coordinate use of individual exercise machines, and to preclude unauthorized users from initiating use of fitness equipment.

While exemplary embodiments of the invention have been described and illustrated, it should be apparent that many modifications can be made to the present invention without departing from its spirit and scope. Accordingly the invention is not limited by the foregoing description or drawings, but is only limited by the scope of the appended claims.

What is claimed as new and desired to be protected by Letters Patent of the United States is:

1. A method for controlling the use of a physical fitness device, the method comprising:

acquiring at a physical fitness device at least one biometric characteristic of a potential user;

identifying said potential user from said biometric characteristics; and determining from a reservation system if a potential user identified by said biometric characteristic is entitled to use said physical fitness device at that time and, if so, enabling use of said physical fitness device.

2. The method according to claim 1 further comprising receiving from said potential user an input of a desired time schedule to use said physical fitness device and entering said desired time schedule into said reservation system.

3. The method according to claim 2 further comprising utilizing said user input desired time schedule in said determining step to determine if said user is entitled to use said physical fitness device.

4. The method according to claim 2 wherein said user input time schedule comprises date, start time, and time duration of use information.

5. The method according to claim 2 wherein said reservation system is comprised of multiple reservation systems in various locations.

6. The method according to claim 5 wherein said desired time schedule comprises desired date, start time, time duration of use, and location information.

7. The method according to claim 2 wherein said potential user is capable of accessing said reservation system over a communications link via a remote or local interface.

8. The method according to claim 7 wherein said communications link is a wired connection.

9. The method according to claim 7 wherein said communications link is a wireless connection.

10. The method according to claim 7 wherein said communications link is an Internet connection.

11. The method according to claim 7 further comprising sending at least one reminder of a scheduled fitness equipment use to said potential user through a user interface.

12. The method of claim 1 wherein a biometric characteristics database stores at least one biometric characteristic from each said potential user of said physical fitness device.

13. The method of claim 12 further comprising the step of comparing said transmitted biometric characteristic entered by said potential user to said stored at least one biometric characteristic to identify said potential user.

14. The method according to claim 1 further comprising monitoring use of said physical fitness device to determine when an allotted timeframe to use said physical fitness device has expired.

15. The method according to claim 14 further comprising disabling said physical fitness device when said allotted timeframe has expired.

16. The method according to claim 1 further comprising enabling use of an unreserved said physical fitness device for a predetermined time duration which does not interfere with a scheduled use of said physical fitness device.

17. A method for controlling use of a physical fitness device, the method comprising:

acquiring biometric information from a potential user of a physical fitness device;

using said acquired biometric information to check a time of use scheduler to see if said potential user is able to use said physical fitness device; and enabling use of said physical fitness device if said scheduler indicates that said identified user is permitted to use said physical fitness device.

18. The method according to claim 17 further comprising receiving from said potential user an input of a desired time schedule to use said physical fitness device and entering said desired time schedule into said time of use scheduler.

19. The method according to claim 18 wherein said user input time schedule comprises date, start time, and time duration of use information.

20. The method according to claim 17 wherein said scheduler is comprised of multiple schedulers in various locations.

21. The method according to claim 20 further comprising receiving from said potential user an input of a desired date, start time, time duration, and location of use information and entering said input into said scheduler.

22. The method according to claim 17 wherein said potential user is capable of accessing said scheduler over a communications link via a remote or local interface.

23. The method according to claim 22 wherein said communications link is a wired connection.

24. The method according to claim 22 wherein said communications link is a wireless connection.

25. The method according to claim 22 wherein said communications link is an Internet connection.

26. The method according to claim 18 further comprising sending at least one reminder of a scheduled fitness equipment use to said potential user through a user interface.

27. The method according to claim 17 wherein said acquired biometric information is transmitted to a biometric characteristics database.

28. The method of claim 27 wherein said biometric characteristics database stores at least one biometric characteristic from each said potential user of said physical fitness devices.

29. The method of claim 28 further comprising comparing said acquired biometric information from said potential user to said stored at least one biometric characteristic to identify said potential user.

30. The method according to claim 17 further comprising monitoring use of said physical fitness device to determine when an allotted timeframe for a user of said physical fitness device has expired.

31. The method according to claim 30 further comprising disabling said physical fitness device when said allotted timeframe device has expired.

32. The method according to claim 17 further comprising enabling use of an unreserved said physical fitness device for a predetermined time duration which does not interfere with a scheduled use of said physical fitness device.

33. A method for scheduling use of a physical fitness device, the method comprising:

storing a requested use schedule for a physical fitness device in association with the identity of a requesting user in response to user input;

acquiring a biometric characteristic at said physical fitness device of a potential user; and providing access to said physical fitness device when the current time coincides with a stored schedule associated with a user identified by said biometric characteristic.

34. The method according to claim 33 further comprising receiving a reservation request from a potential user containing information of a date and time period of use requested and storing said reservation request in association with a user identification if said physical fitness device is available for the period of use requested.

35. The method according to claim 34 further comprising sending at least one reminder of a scheduled fitness equipment use to said potential user through a user interface.

36. The method of claim 34 further comprising comparing said provided biometric characteristic entered by said potential user with a stored at least one biometric characteristic to identify said potential user.

37. The method according to claim 33 further comprising monitoring use of said physical fitness device to determine when an allotted time frame of use of said physical fitness device has expired.

38. The method according to claim 37 further comprising disabling said physical fitness device when said allotted timeframe has expired.

* * * * *